United States Patent [19]

Meinen

[11] Patent Number: 4,817,555

[45] Date of Patent: Apr. 4, 1989

[54] BOAT FLOTATION COLLAR

[76] Inventor: Lee O. Meinen, Rte. 5, Box 1094, Edinburg, Tex. 78539

[21] Appl. No.: 101,269

[22] Filed: Sep. 25, 1987

[51] Int. Cl.[4] ..... B63B 5/24

[52] U.S. Cl. ..... 114/360; 114/219; 114/68

[58] Field of Search ..... 114/343, 345, 348, 360, 114/219, 230, 123, 68, 49, 50, 44, 52–54; 116/109, 110, DIG. 8; 441/96; 267/118

[56] References Cited

U.S. PATENT DOCUMENTS

| | | | |
|---|---|---|---|
| 1,038,928 | 9/1912 | Menzel | 114/360 |
| 1,414,298 | 4/1922 | Montero | 116/110 |
| 1,587,710 | 6/1926 | Fiala | 114/352 |
| 2,924,192 | 2/1960 | Salvage | 114/348 |
| 3,121,888 | 2/1964 | Morgan | 114/360 |
| 3,906,795 | 9/1975 | Kask | 116/110 |
| 4,548,150 | 10/1985 | Drewett | 114/219 |
| 4,627,373 | 12/1986 | Hishida | 114/219 |

FOREIGN PATENT DOCUMENTS

| | | | |
|---|---|---|---|
| 537115 | 6/1941 | United Kingdom | 114/360 |

*Primary Examiner*—Joseph F. Peters, Jr.
*Assistant Examiner*—Clifford T. Bartz
*Attorney, Agent, or Firm*—Leon Gilden

[57] ABSTRACT

A boat flotation collar is set forth wherein a generally "U" shaped upwardly oriented bumper guard is positioned longitudinally of a boat and attachable thereto. Within the upstanding "U" shaped bumper guard is an inflatable bag or series of bags that upon raising of a float within the interior of a boat by rising water will open a valve secured to a compressed gas bottle. Inflatable pneumatic cells positioned within the "U" shaped bumper guard will thereby be inflated to prevent the associated boat from sinking.

6 Claims, 1 Drawing Sheet

BOAT FLOTATION COLLAR

BACKGROUND OF THE INVENTION

1. Field of the Invention

The present invention relates to flotation devices, and more particularly pertains to a new and improved boat flotation device which when not being utilized performs the function of a protective bumper about the boat and upon need arising will effect flotation of pneumatic cells positioned within the bumper guard.

2. Description of the Prior Art

The use of boat flotation devices is well known in the prior art. As may be appreciated, these devices have normally required substantial room to accommodate their positioning or in other instances, have included bulky or awkward mechanisms that were either slow or insufficient in response to situations where flotation of the associated boat was immediately required. In this connection, there have been several attempts to develop boat flotation devices which may be easily stored and efficiently utilized when need would dictate. For example, U.S. Pat. No. 1,587,710 to Fiala sets forth a longitudinally positionable flotation device for use with a boat and more particularly with canoes. A rigid longitudinal downwardly oriented bracket is secured along a partial length of a canoe wherein pre-inflated tubular elements are inflated. It may be appreciated therefore that the Fiala patent does not adequately address the problem of space as well as not providing adequate means for protection of the boat itself from impact.

U.S. Pat. No. 2,848,725 to Sloulin is a somewhat improvement over the aforenoted patent in that in an entirely encased flotation unit is secured to either side of a boat or canoe. The need to pre-inflate and maintain such inflation of a rail as set forth in the Sloulin patent tends to encourage situations where the tubular inflatable cell due to age or wear may lose its air carrying ability and thereby its effectiveness.

U.S. Pat. No. 2,932,040 to Dobkowitz sets forth perimeter members positionable at lower terminal portions of a boat to prevent capsizing of the associated boat and are accordingly bulky, awkward, and are of questionable navigable usefulness due to presenting a perimeter greater than that of the boat and below eye level, as the invention is positioned proximate the water line of the boat.

U.S. Pat. No. 3,121,888 to Morgan, et al, sets forth a pre-positioned perimeter flotation device wherein a gaseous cylinder is positioned in alignment with a prepositioned inflation cell and upon mechanical actuation, the inflation elements will be inflated. Unfortunately, this patent further lacks the automatic inflation required in emergency situations to prevent sinking of an associated boat. Furthermore, the associated guard about the flotation cell completely encircles the flotation cell and therefore discourages periodic inspection of such inflation cells, as is necessary in routine boat maintenance.

U.S. Pat. No. 4,458,618 to Tuffier sets forth a manually actuable bottle gas member that upon actuation will inflate a series of cells positioned about the interior of an associated boat. While an effective means of maintaining a boat from sinking and such, a minimal of interior room remains after inflation of the various cells and accordingly limits mobility in a situation that would mandate such. The need for an effective compact device is not met by this patent.

U.S. Pat. No. 4,495,880 to Maniscalco presents a buoyancy device for minimizing draft of an associated vessel for enhanced navigational purposes. Essentially, a plurality of air-filled chambers associated by means of a webbing supports and lifts a boat to reduce its draft when the webbing is positioned underneath the associated boat. The obvious cumbersome and awkward nature of this device limits its applicability to emergency situations. The patent's effectiveness should be confined to navigational enhancement as opposed to emergency situation devices.

As such it may appreciated that there is a continuing need for a new and improved boat flotation device which addresses both the problem of storage, effectiveness, and response when need arises and in this respect, the present invention substantially fulfills these requirements.

SUMMARY OF THE INVENTION

In view of the foregoing disadvantages inherent in the known types of boat flotation devices now present in the prior art, the present invention provides a boat flotation device wherein the same can be compactly stored when not in use and may be further readily, effectively, and automatically effected into operation when need dictates. As such, the general purpose of the present invention, which will be described subsequently in greater detail, is to provide a new and improved boat flotation device which has all the advantages of the prior art boat flotation devices and none of the disadvantages.

To attain this, the present invention comprises an upwardly oriented "U" shaped bumper securable to the upper longitudinal perimeter of an associated boat or other water craft device. Positioned therein is a single or series of pneumatic cells that are inflated upon water within the confines of the associated water craft rising to a level to engage a float and thereby actuate a valve releasing compressed gas from within the confines of a cylinder.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat flotation collar which has all the advantages of the prior art boat flotation collars and none of the disadvantages.

It is another object of the present invention to provide a new and improved boat flotation collar which may be easily and efficiently manufactured and marketed.

It is a further object of the present invention to provide a new and improved boat flotation collar which is of a durable and reliable construction.

An even further object of the present invention is to provide a new and improved boat flotation collar which is susceptible of a low cost of manufacture with regard to both materials and labor, and which accordingly is then susceptible of low prices of sale to the consuming public, thereby making such boat flotation collar economically available to the buying public.

Still yet another object of the present invention is to provide a new and improved boat flotation collar which provides in the apparatuses and methods of the prior art some of the advantages thereof, while simultaneously overcoming some of the disadvantages normally associated therewith.

Still another object of the present invention is to provide a new and improved boat flotation collar that performs the function of a perimeter bumper guard about a boat and when acutated, houses therein a single or series of inflatable cells to maintain flotation of the associated water craft.

Yet another object of the present invention is to provide a new and improved boat flotation collar that is automatically actuated upon water within a boat rising to an undesirable pre-determined level.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
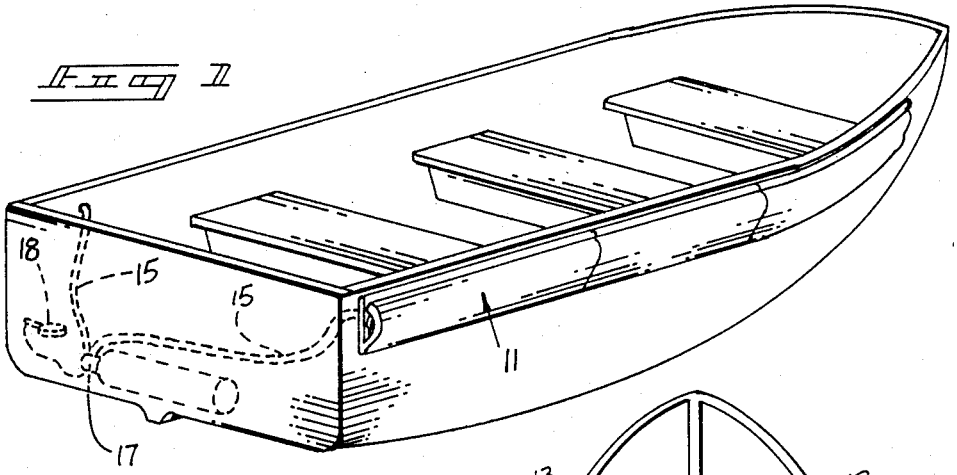
FIG. 1 is an isometric view of my invention illustrating the "U" shaped bumper guard positioned about a perimeter of an associated water craft and further in illustration, the adjoining compressed gas bottle, its conduits and its flotation actuation element in phantom.

With reference now to the drawings, and in particular to FIG. 1 thereof, a new and improved boat flotation collar embodying the principles and concepts of the present invention and generally designated by the reference numeral 10 will be described.

Figure 4:
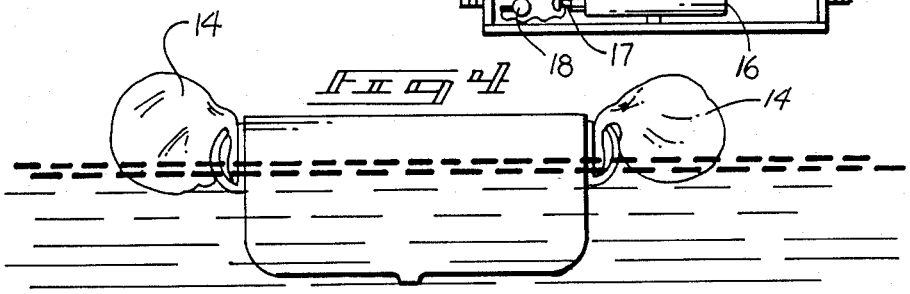
FIG. 4 is an end of orthographic view in elevation illustrating the actuation of the pneumatic cells from within the "U" shaped bumper guards.

More specifically, it will be noted that the boat flotation collar essentially comprises a "U" shaped bumper guard portion 11 formed with a curvilinear exterior facing leg 12 and a substantially planar leg 13 to be affixed to an associate upper perimeter of a boat. Outer curvilinear leg 13 is formed of a relatively impact resistant plastic-light material wherein the leg 12 in conjunction with leg 13 performs as a protective bumper when the pneumatic cells of the instant invention are not inflated. In this manner, the flotation collar apparatus 10 appears as a conventional bumper guard, as may be typically associated with boats and, as such, more readily accepted for use. Folded within the interior of each "U" shaped bumper guard 11 is a pneumatic cell 14. As illustrated in FIG. 4, upon actuation pneumatic cells 14 immediately are expanded to beyond the interior confines of bumper guards 11 and thereby effect flotation of an associated water craft. As ilustrated, the planar legs 13 of the instant invention are securedly associated with the upper perimeter or gunwale portion of the water craft and in this fashion requires little or no maintenance other than the normal periodic inspection of pneumatic cells 14 to insure their integrity. Furthermore, inasmuch as bumper guards 11 are open at their ends, water entering either bumper guard 11 through the normal fall of rain or that associated with boating is readily drained from within bumper guards 11 and thereby requires no periodic cleaning or draining.

Figure 2:
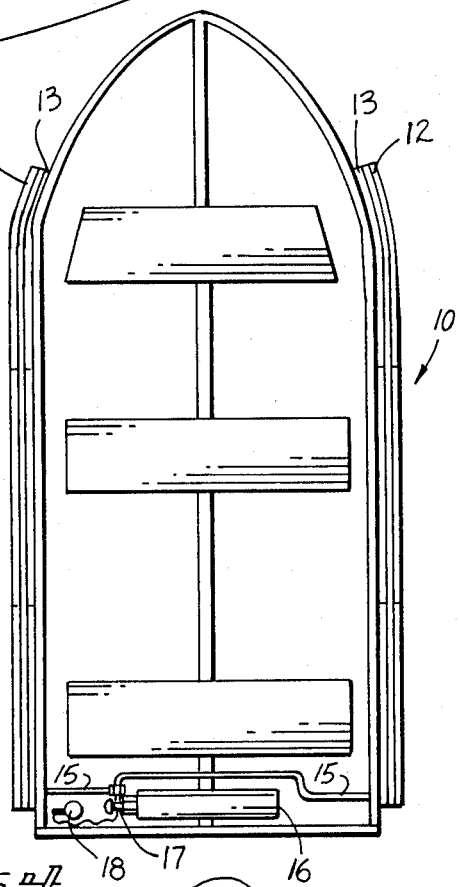
FIG. 2 is a top orthographic view of the boat flotation collar illustrating the various components, their configuration and positioning within a boat.
Figure 3:
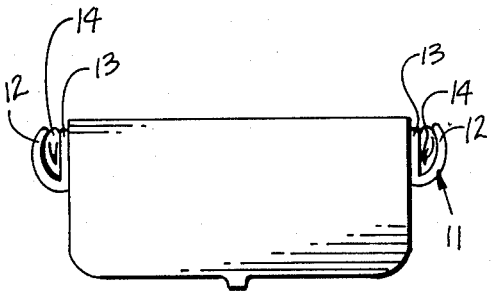
FIG. 3 is an end orthographic view in elevation of the "U" shaped bumper guard housing the associated pneumatic flotation cells.

Air transport conduits 15, as illustrated in FIGS. 1 and 2, transport compressed air normally contained within a compressed air bottle 16 positioned, as illustrated, in any convenient portion within the associated boat or water craft. A conventional electrically actuated solenoid-type valve 17 of well known construction is positioned on air bottle 16, as illustrated, and is actuated by flotation switch member 18 associated therewith by wiring of construction well known in the art to complete an electrical circuit to actuate valve 17. Voltage to operate valve 17 by flotation switch member 18 may be derived by the use of a normal storage battery utilized in water craft or, if deemed necessary, a simple dry cell may be utilized to provide electrical energy.

As to the manner of usage and operation of the present invention, the same should be apparent from the above description. Accordingly, no further discussion relative the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flotation device for use with water craft comprising, an elongate guard means of a generally "U" shaped cross-sectional configuration including an open top portion for securement about an upper perimeter of said water craft, and an elongate expandable pneumatic cell means positionable in a first position defining a first volume completely within the interior formed by said "U" shaped configuration of said bumper guard means, and compressed air means for inflating said pneumatic cell means to a second volume and a second position substantially exteriorly of said interior of said bumper guard means wherein said second volume is substantially greater than said first volume, and wherein said bumper guard means are of finite length with terminal end portions wherein said terminal end portions are open to enable drainage of undesirable water from each end portion.

2. A flotation device as set forth in claim 1 including a float means positionable within the interior of said water craft for detection of rising water to actuate said compressed air means to release contained air of said pneumatic cell means.

3. A flotation device for use with water craft as set forth in claim 2 wherein said compressed air means includes a valve means actuable by said float means.

4. A flotation device for use with water craft as set forth in claim 3 wherein said valve means is a solenoid valve.

5. A flotation device as set forth in claim 4 wherein said compressed air means further includes a pressurized container of compressed gas.

6. A flotation device as set forth in claim 1 wherein said compressed air means includes at least one conduit associated with each pneumatic cell means to direct compressed air thereto

* * * * *